US007135953B2

(12) United States Patent
Leitl et al.

(10) Patent No.: US 7,135,953 B2
(45) Date of Patent: Nov. 14, 2006

(54) ADJUSTING DEVICE FOR A THERMAL TRIP

(75) Inventors: Wolfgang Leitl, Wenzenbach (DE); Christoph Weber, Ergoldsbach (DE)

(73) Assignee: Siemens Aktiengesellschaft, Munich (DE)

( * ) Notice: Subject to any disclaimer, the term of this patent is extended or adjusted under 35 U.S.C. 154(b) by 221 days.

(21) Appl. No.: 10/477,700

(22) PCT Filed: Jun. 19, 2002

(86) PCT No.: PCT/DE02/02223

§ 371 (c)(1),
(2), (4) Date: Nov. 14, 2003

(87) PCT Pub. No.: WO03/005395

PCT Pub. Date: Jan. 16, 2003

(65) Prior Publication Data

US 2004/0140881 A1 Jul. 22, 2004

(30) Foreign Application Priority Data

Jul. 2, 2001 (DE) ..... 101 31 963
Oct. 15, 2001 (DE) ..... 201 16 792 U

(51) Int. Cl.
*H01H 37/20* (2006.01)
*H01H 37/52* (2006.01)
*H01H 37/04* (2006.01)

(52) U.S. Cl. ..... 337/84; 337/82; 335/45; 335/145

(58) Field of Classification Search ..... 337/36, 337/37, 57, 67, 82, 84, 93, 94, 319, 323, 337/330, 347, 349, 357, 360, 368, 374, 95, 337/96, 335, 336; 335/45, 144, 185, 197, 335/186, 145; 361/163
See application file for complete search history.

(56) References Cited

U.S. PATENT DOCUMENTS

| | | | | |
|---|---|---|---|---|
| 3,665,360 | A * | 5/1972 | Norden | 337/100 |
| 3,950,714 | A * | 4/1976 | Mrenna et al. | 335/35 |
| 4,510,481 | A * | 4/1985 | Ubukata et al. | 337/368 |
| 4,630,019 | A * | 12/1986 | Maier et al. | 337/70 |
| 4,815,312 | A | 3/1989 | Jacquet et al. | |
| 4,825,186 | A | 4/1989 | Bayer | |
| 5,317,471 | A | 5/1994 | Izoard et al. | |
| 5,837,954 | A * | 11/1998 | Asakawa et al. | 218/40 |
| 5,894,259 | A * | 4/1999 | Kolberg et al. | 337/333 |
| 6,135,633 | A | 10/2000 | DiMarco et al. | |
| 6,445,273 | B1 * | 9/2002 | Yu | 337/37 |
| 6,621,403 | B1 * | 9/2003 | Nagahiro et al. | 337/75 |
| 6,661,329 | B1 * | 12/2003 | Gibson | 337/84 |
| 6,816,055 | B1 * | 11/2004 | Weber | 337/82 |

FOREIGN PATENT DOCUMENTS

DE 1 904 731 8/1970

(Continued)

*Primary Examiner*—Anatoly Vortman
(74) *Attorney, Agent, or Firm*—Harness, Dickey & Pierce P.L.C.

(57) ABSTRACT

An adjusting device is for a thermal trip of a switchgear. It includes a bimetal, which is held in a fixed manner on a bimetal support, whose free end is located at a distance from a tripping lever, and which increasingly acts upon this tripping lever in a tripping direction as a result of thermal deformation. A distance can be adjusted by deforming the bimetal support. The adjusting device is particularly suited for use in circuit-breakers or the like.

39 Claims, 9 Drawing Sheets

FOREIGN PATENT DOCUMENTS

| | | | |
|---|---|---|---|
| DE | 1904731 | | 8/1970 |
| DE | 26 46 840 | | 4/1978 |
| DE | 2646840 | | 4/1978 |
| DE | 35 17 039 | | 11/1986 |
| DE | 3517039 | | 11/1986 |
| DE | 689 07 633 | | 10/1989 |
| EP | 0 143 981 | | 6/1985 |
| EP | 0143981 | | 6/1985 |
| EP | 0 213 270 | | 3/1987 |
| EP | 0213270 | A1 | 3/1987 |
| EP | 338868 | A1 | 10/1989 |
| EP | 0412953 | | 2/1991 |
| EP | 0 412 953 | | 8/1994 |
| EP | 0 913 848 | | 5/1999 |
| EP | 0913848 | A2 | 5/1999 |
| FR | 0 338 868 | | 10/1989 |
| GB | 2 285 886 | | 7/1995 |
| GB | 2285886 | | 7/1995 |

* cited by examiner

ADJUSTING DEVICE FOR A THERMAL TRIP

This application is the national phase under 35 U.S.C. § 371 of PCT International Application No. PCT/DE02/02223 which has an International filing date of Jun. 19, 2002, which designated the United States of America and which claims priority on German Patent Application numbers DE 101 31 963.0 filed Jul. 2, 2001 and DE 201 16 792.1 filed Oct. 15, 2001, the entire contents of which are hereby incorporated herein by reference.

FIELD OF THE INVENTION

The invention generally relates to an adjustment apparatus for a thermal release or trip for a switching device. In this case, the expression switching device refers to mechanical or electromechanical switching devices, in particular line circuit breakers, power breakers, relays, contactors or the like.

BACKGROUND OF THE INVENTION

An adjustment apparatus is known from EP 0 913 848 A2.

A switching device is used for connecting a circuit to a power supply system and for manual and automatic disconnection of the circuit from the power supply system when the current exceeds a predetermined value. Thus, for example, a line circuit breaker is used for protecting lines in installations and systems from overloading and short-circuits. In a power supply system in which disconnection is provided by overcurrent protective devices, a switching device such as this additionally prevents the existence of high direct contact voltages in the event of a fault.

When the switching device or circuit breaker is switched on, an energy store, for example a spring, is loaded as part of a mechanical switching mechanism. This energy is released during the tripping process, and operates the switch. In this case, the switching device has a thermal release in the form of a conventional bimetallic strip, which trips with a delay as a function of the overload time. The tripping process is initiated by thermal deformation of the bimetallic strip as a result of an overcurrent being passed through it.

This is done by a tripping lever, which is opposite the free end of the bimetallic strip, is at a distance from it, and is mechanically coupled to the switching mechanism, being acted on by the bimetallic strip. Thus, via this, the bimetallic strip unlatches the switching mechanism, while the energy store of the switching mechanism opens a moving contact, by lifting the latter off a fixed contact. Furthermore, the switching device normally additionally has a magnetic or electromagnetic release, which trips without any delay, for high surge currents and short-circuit currents.

The distance between the free end of the bimetallic strip and the tripping lever can be designed to be adjustable, and an adjusting screw is normally provided for this purpose. Switching devices in which an adjusting screw such as this is used to adjust the bimetallic strip are known, for example, from DE 1 904 731 A1, from EP 0 143 981 A1 and from EP 0 412 953 A3. However, the use of an adjusting screw is associated with corresponding production and manufacturing costs.

Furthermore, EP 0 913 848 A2 discloses a method for thermal calibration of the tripping mechanism of a switching device, and a corresponding tripping mechanism, in which the adjustment is carried out thermally by use of a laser.

SUMMARY OF THE INVENTION

An embodiment of the invention includes an object of specifying a particularly cost-effective adjustment apparatus, which can be adjusted easily, for a switching device, in particular for a line circuit breaker.

The bimetallic strip mount has a holding limb, which runs parallel to the bimetallic strip, is connected to its contact end and has a fixing end as a fixed attachment point. This holding limb, which is preferably curved in the form of a step, is adjacent on one side to a handling limb, which acts as an adjustment area, and on the other side via a bend to an at least approximately U-shaped fixing limb of the bimetallic strip mount. The stepped contour of the holding limb makes it possible to hold bimetallic strips of different length, in particular also including bimetallic strips which can be heated indirectly, by means of the same bimetallic strip mount. This makes it possible to considerably reduce the number of different thermal releases which have to be provided or kept available for different types of switching device and, in particular, to keep this number small overall.

The setting of the distance between the bimetallic strip and the tripping lever and hence the adjustment of the thermal release are expediently carried out by twisting the handling limb, which runs transversely with respect to the holding limb and acts as an adjustment area for the bimetallic strip mount. For this purpose, the handling limb is advantageously in the form of a perforated plate. In this case, a number of through-openings, preferably in the form of round holes, are incorporated in the handling limb.

The handling limb of the bimetallic strip mount can be fixed in position in a housing opening or contour whose position is fixed and which also acts as an opening for rotation. For this purpose, the handling limb is expediently positioned in the area of the free end of the bimetallic strip. Alternatively, the bimetallic strip mount may be shaped like a loop, with the handling limb then being supported at the end on the bimetallic strip mount. In this embodiment, a desired bending point is preferably provided in the area of the loop apex of the bimetallic strip mount.

The switching device has a housing which is formed from urea and/or melamine resin molding compound. The urea or melamine resins, which are included in the family of thermosetting plastics, are particularly suitable for cost-reducing production of mass-produced items and batch-produced items.

The advantages that are achieved by an embodiment of the invention are, in particular, that suitable refinement and arrangement of a bimetallic strip mount to which the bimetallic strip is fitted allows the bimetallic strip mount to be deformed deliberately, thus making it possible to provide a simple and low-cost adjustment apparatus, which if required is self-adjusting, for a thermal release for a switching device. The distance between the free end of the bimetallic strip and the tripping lever can in this case be set or adjusted on the one hand by deformation, in particular by twisting, if necessary by way of a tool for the handling and holding limb, and on the other hand makes it possible to compensate for ageing-dependent housing shrinkage resulting from autonomous bending of the bimetallic strip mount.

This mechanism, which is used to adjust the bimetallic strip, and in which the bimetallic strip mount that holds the bimetallic strip is mounted fixed to the housing via two attachment points, one fixed attachment point of which ensures robust mounting of the bimetallic strip—and thus of the thermal release—while the other attachment point includes the adjusting device for adjustment of the bimetallic strip by deformation, allows fine and exact adjustment of the thermal release.

BRIEF DESCRIPTION OF THE DRAWINGS

The present invention will become more fully understood from the detailed description of preferred embodiments given hereinbelow and the accompanying drawings, which are given by way of illustration only and thus are not limitative of the present invention, and wherein.

Parts which correspond to one another are provided with the same reference symbols in all the figures.

DETAILED DESCRIPTION OF THE PREFERRED EMBODIMENTS

Figure 1:
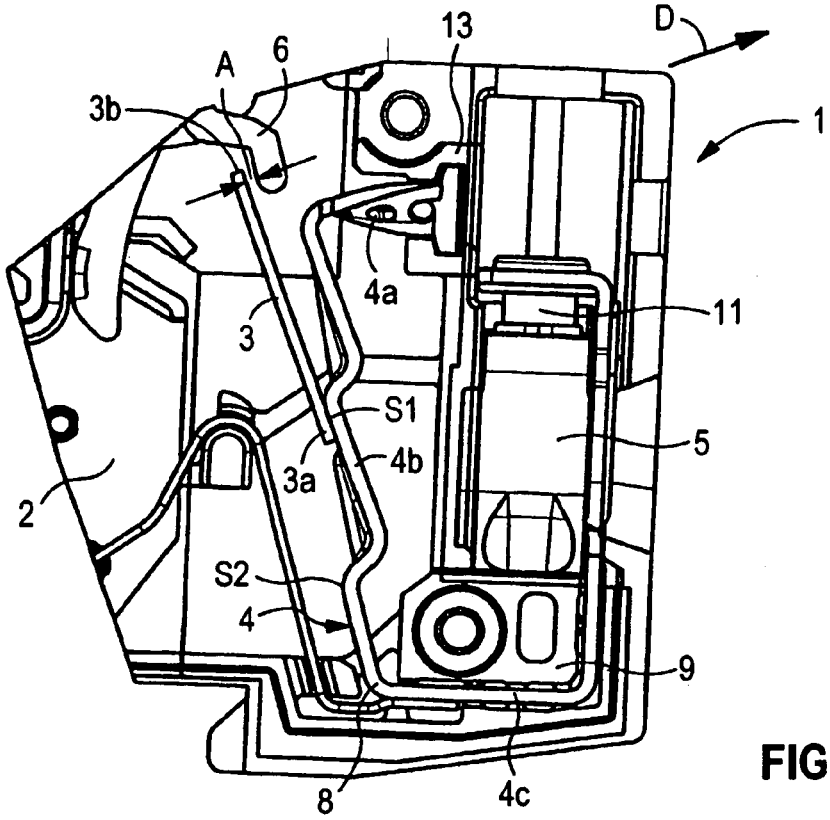
FIGS. 1 and 2 show, respectively, in the form of a plan view and a perspective illustration, a thermal release which is finally mounted in a switching device and has an adjustment apparatus with a bimetallic strip mount that can be twisted and has a short bimetallic strip.

FIGS. 1 to 4 show, in the form of details, a switching device 1 with the housing cover of its housing 2 lifted off, in which the essential parts of an adjustable thermal release are shown such that they are visible. The thermal release has a bimetallic strip 3, whose contact end 3*a* is connected by techniques such as bonding, soldering or welding to a bimetallic strip mount 4, and is thus held in a fixed position. The bimetallic strip mount 4 is electrically conductively connected via the switching device 1 to a connecting terminal 5, in order to supply power.

The free end 3*b* of the bimetallic strip 3, that is to say the tip of the bimetallic strip, is opposite and at a distance from a tripping lever 6, which is coupled in a manner known per se to a switching mechanism, which is not illustrated in any more detail. This distance A between the tip of the bimetallic strip 3*b* and the tripping lever 6 can be adjusted by bending or deformation of the bimetallic strip mount 4.

Figure 2:
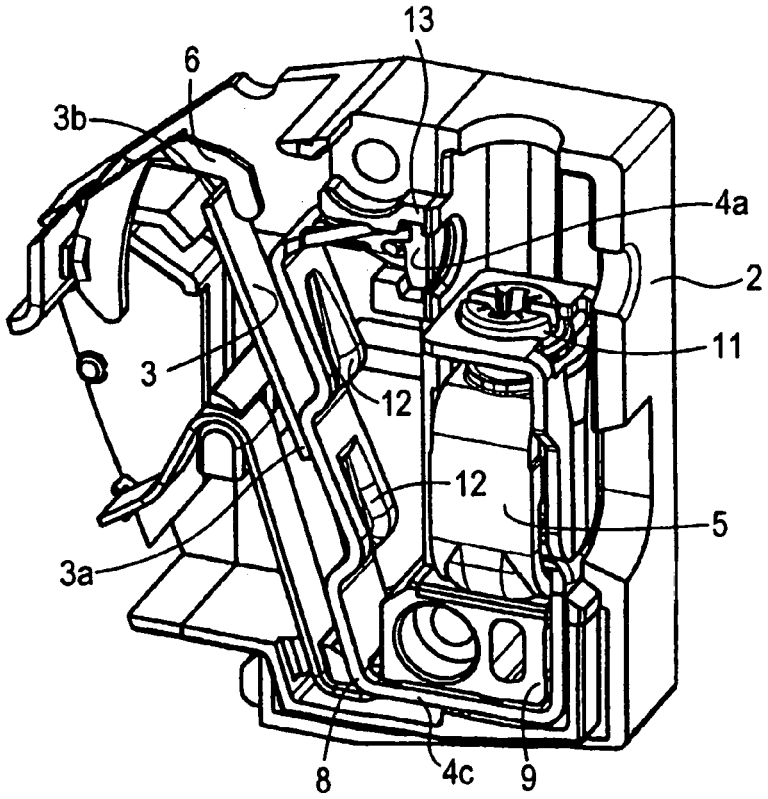
Figure 3:
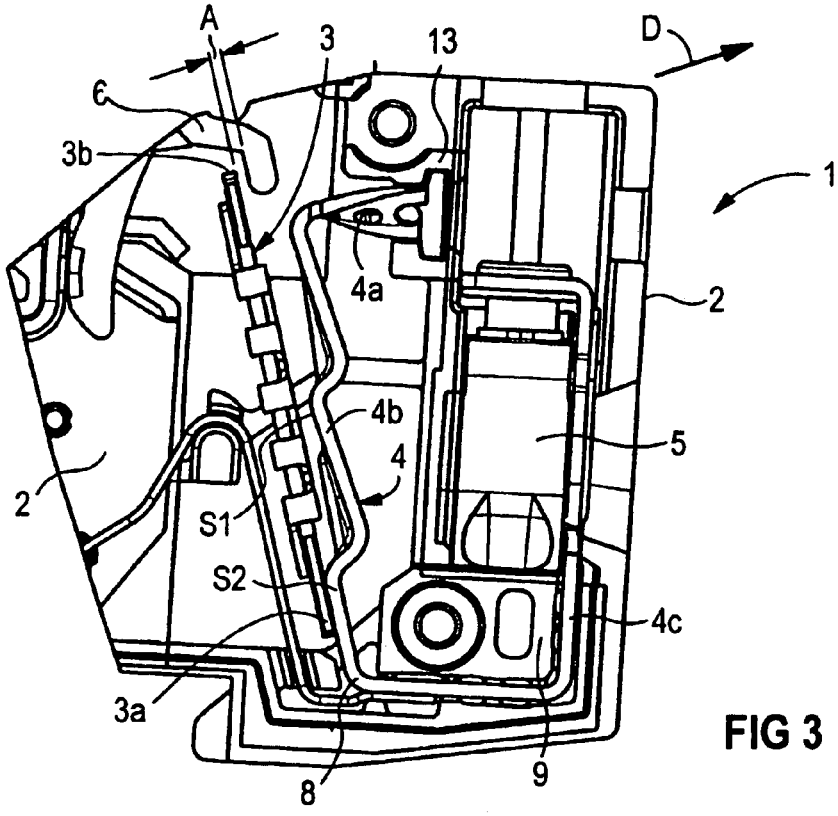
FIGS. 3 and 4 show, in illustrations corresponding to FIGS. 1 and 2 respectively, the adjustment apparatus with a long bimetallic strip.
Figure 4:
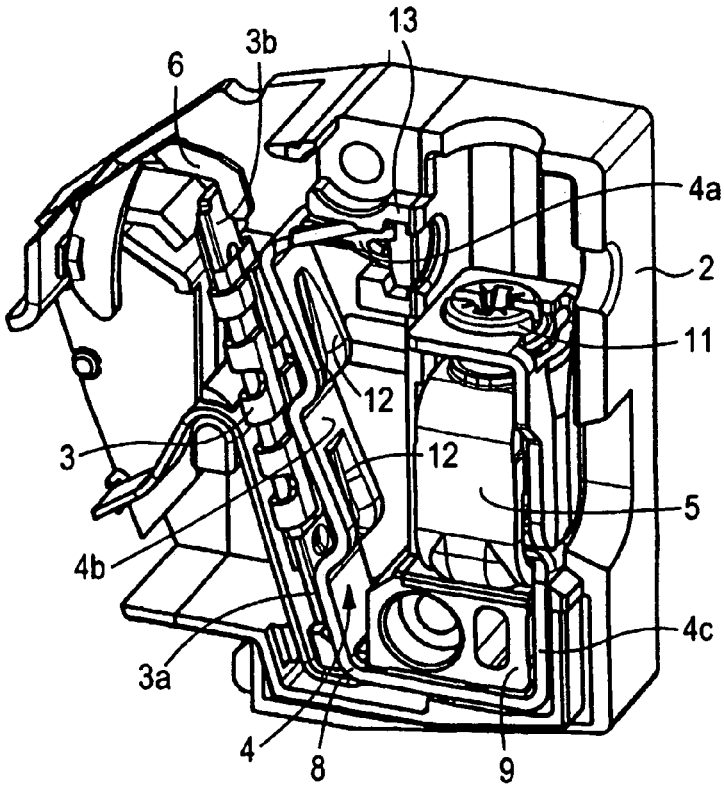

The bimetallic strip mount 4 is shaped such that it has two or more bends or curves, and is additionally in the form of a step. In this case, a bimetallic strip 3 can be fixed by its contact end 3*a* on each step S1, S2, and thus in different positions or at different connecting points on the bimetallic strip mount 4. Thus, both a short bimetallic strip 3 as shown in FIGS. 1 and 2 and a comparatively long bimetallic strip 3 as shown in FIGS. 3 and 4, which may be designed such that it can be heated indirectly, can be fixed or fitted to the same bimetallic strip mount 3. The thermal release can thus be configured for different current levels, with optimum material savings.

The bimetallic strip mount 4 has a handling limb 4*a* and a holding limb 4*b*, which runs transversely with respect to it, that is to say it runs at least approximately at right angles. The contact end 3*a* of the bimetallic strip 3 is connected to this holding limb 4*b* by techniques such as bonding, soldering or brazing. The holding limb 4*b* merges at a bend point 8 into a fixing limb 4*c*, which is itself curved to be approximately U-shaped. The bimetallic strip mount 4 is fixed in position by this fixing limb 4*c* in the housing 2 by means of corresponding housing fittings or contours 9, and is fixed in place clamped by means of a connecting screw 11. In this case, at least a part of the limb length of the holding limb 4*b* is inserted in the housing 2, without touching it. Beads 12 are incorporated in the holding limb 4*b* in the area of the steps S1 and S2, so that a relatively thin sheet-metal material can be used for the bimetallic strip mount 4, with high dimensional stability and adequate load-bearing stiffness.

The handling limb 4*a* (which is located in the area of the free end 3*b* of the bimetallic strip 3 where it points outwards) of the bimetallic strip mount 4 is held at the end in a housing opening or contour 13, where it is supported. The handling limb 4*a* is designed such that it can be deformed. In this case, the handling limb 4*a* of the bimetallic strip mount 4 is twisted by way of a handling tool (which is not illustrated) in order to adjust the bimetallic strip and thus to set the distance A between the free end 3*b* of the bimetallic strip 3 and the tripping lever 6, so that the bimetallic strip mount 4 is bent or deformed. In consequence, the position of the bimetallic strip 3 is varied appropriately in order to adjust the distance A.

The twisting of the handling limb 4*a* thus results in rotation of the bimetallic strip 3 and thus of its free end or bimetallic strip tip 3*b* in the tripping direction D. The adjustment apparatus is in this case essentially formed by the fixed-position handling limb 4*b* of the bimetallic strip mount 4, with the bimetallic strip 3 held on it.

Figure 5A:
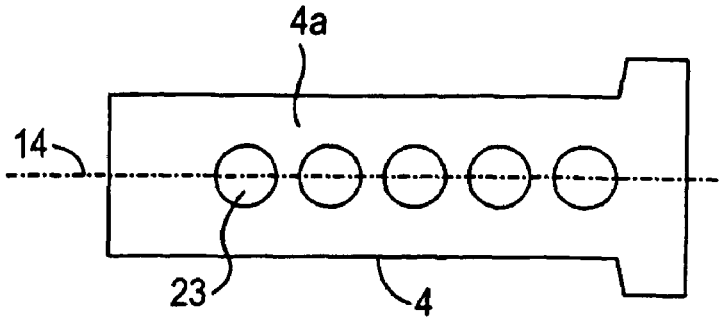
FIGS. 5*a* to 5*d* show different geometries of a handling limb of the adjustment apparatus as shown in FIGS. 1 to 4, FIGS. 6 and 7 show, respectively, a side view and a perspective illustration of an adjustment apparatus with a bimetallic strip mount which can be deformed in an alternative manner.
Figure 5B:
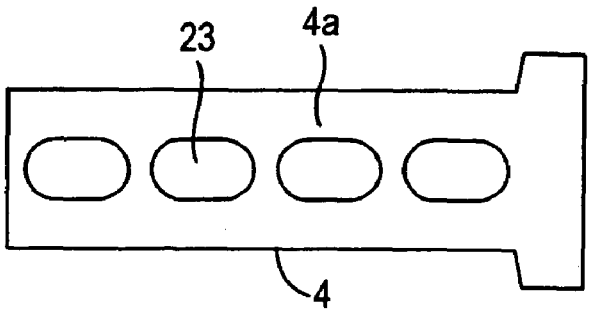
Figure 5C:
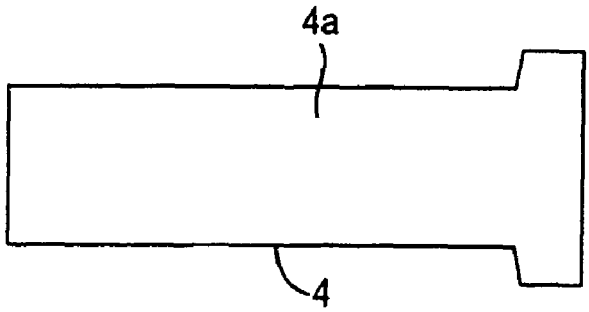
Figure 5D:
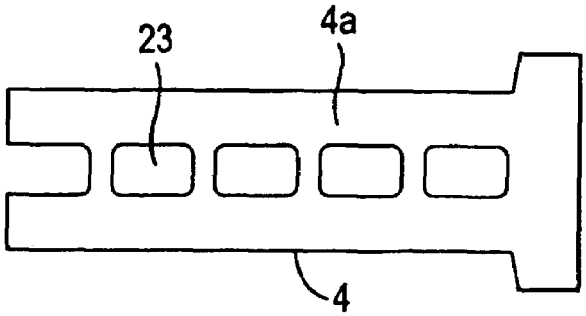

FIGS. 5*a* to 5*d* show different geometries of the handling limb 4*a* of the bimetallic strip mount 4. While, in principle, this T-shaped handling limb 4*a* as shown in FIG. 5*c* can be formed from solid material, through-openings 23 are expediently incorporated along the limb longitudinal axis 14 in the handling limb 4*a*, and thus in the adjustment area of the bimetallic strip mount 4. As is shown in FIGS. 5*b* and 5*d*, these through-openings 23 may be in the form of elongated holes or rectangular openings. However, a number of circular holes 23 as shown in FIG. 5*a* are advantageous. This is because this geometry makes it possible to achieve a particularly advantageous ratio between the rotation angle and the change in the length of the handling limb 4*a*. This results in the desired aim to a particularly high degree of allowing fine and accurate adjustment with a comparatively large rotation angle and a small change in length.

Figure 6:
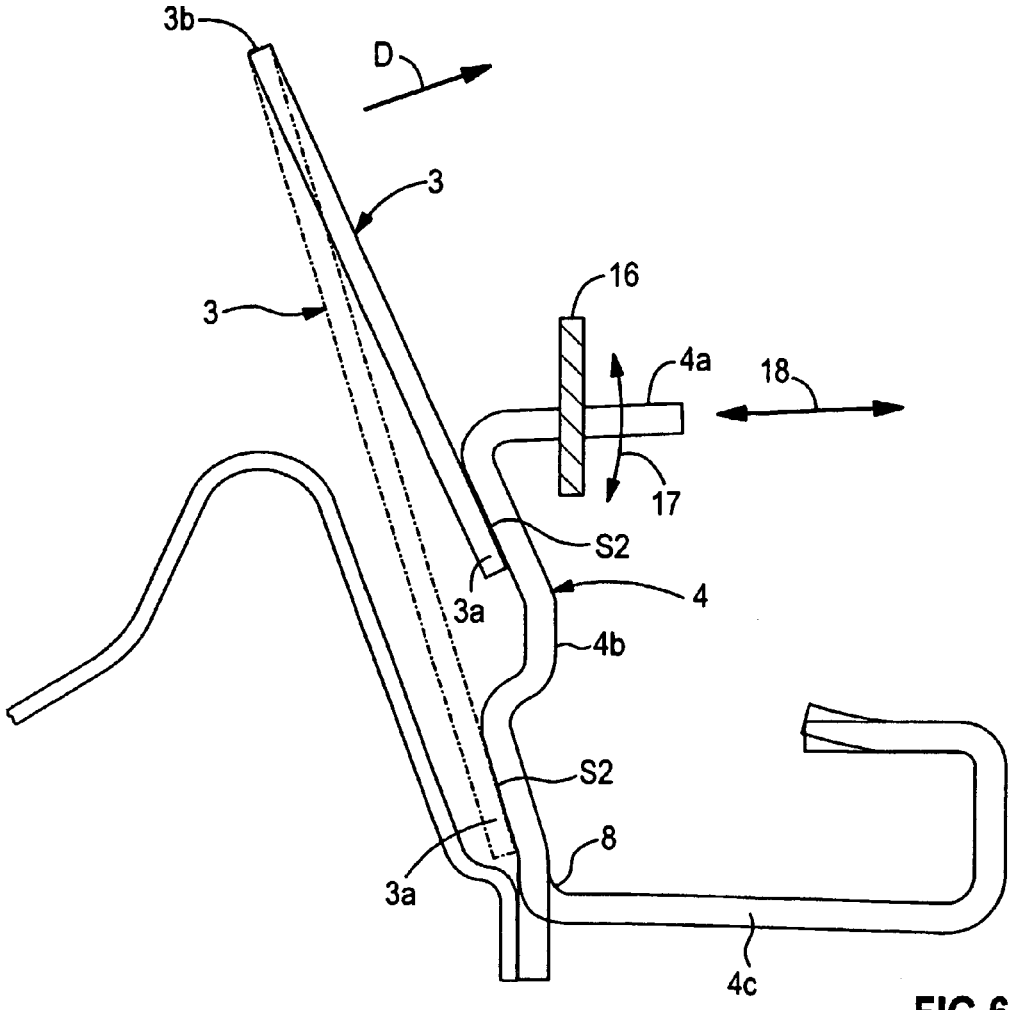
Figure 7:
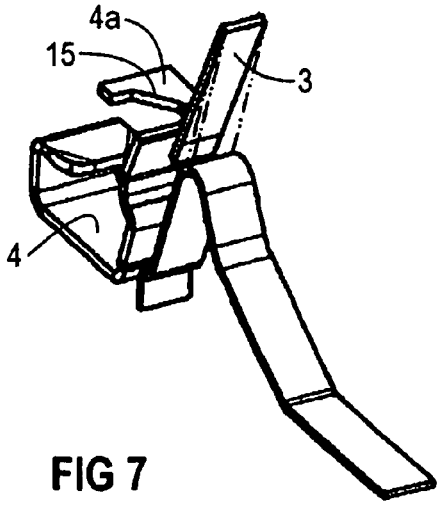

In the embodiment of the adjustment apparatus illustrated in FIGS. 6 and 7, the handling limb 4*a* is provided with a tab-like contour 15, which can be guided along a curved opposing contour 16, which is fixed to the housing and whose position is thus fixed. In this embodiment, the adjustment and hence the setting of the distance A are carried out by bending the handling limb 4*a* in the direction of the arrow 17. In the process, as it slides along the curved fixed-position opposing contour 16 over the tab-like contour 15, the handling limb 4*a* is moved in the direction of the arrow 18, so that the bimetallic strip tip 3*b* is in turn moved in the tripping direction D. The length of the movement path (as symbolized by the arrow 17) of the handling limb 4*a* in this case depends on the gradient of the curved, fixed-position opposing contour 16.

Figure 8:
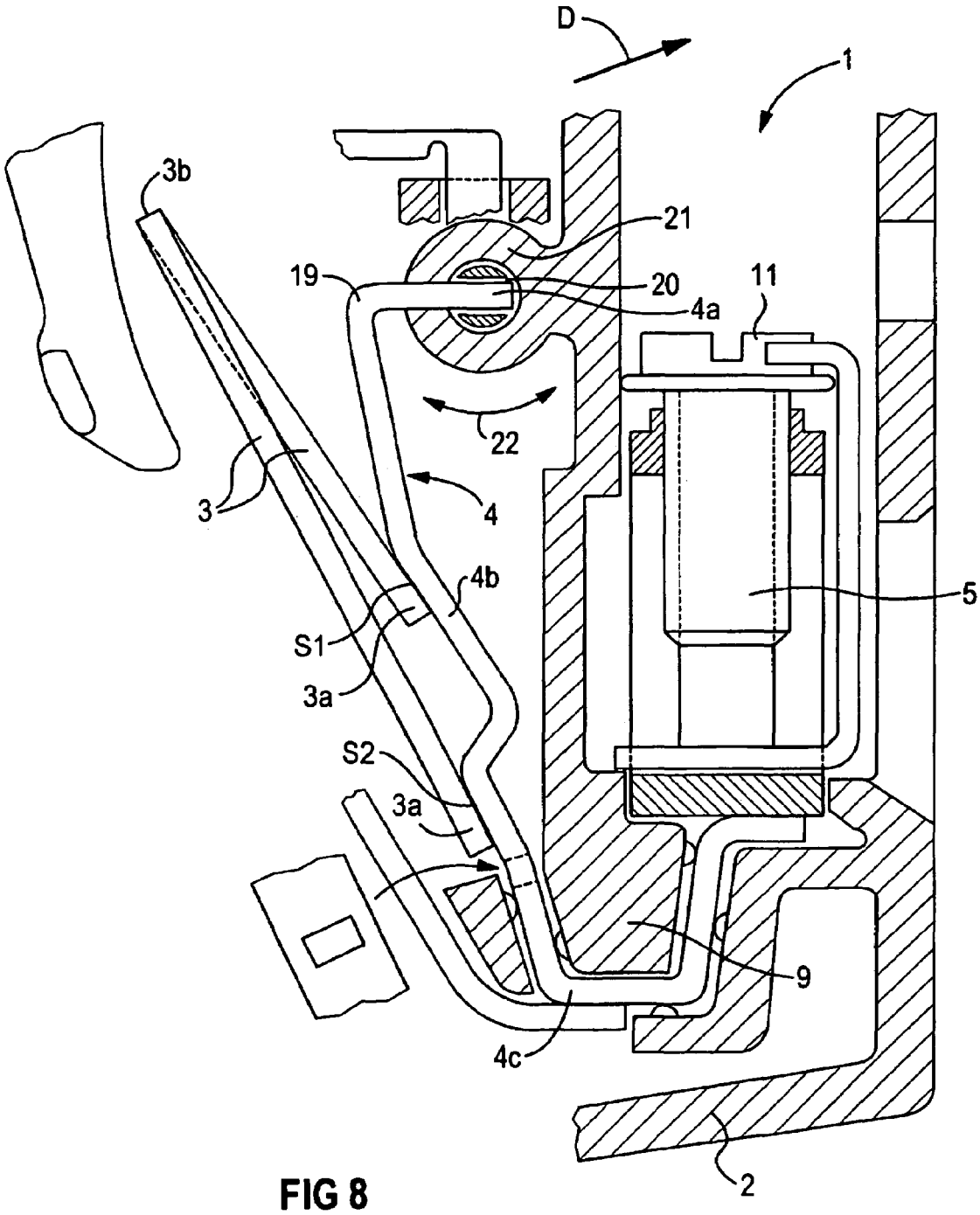
FIGS. 8 to 11 show section illustrations of various variants of the deformation mechanism of the adjustment apparatus.
Figure 9:
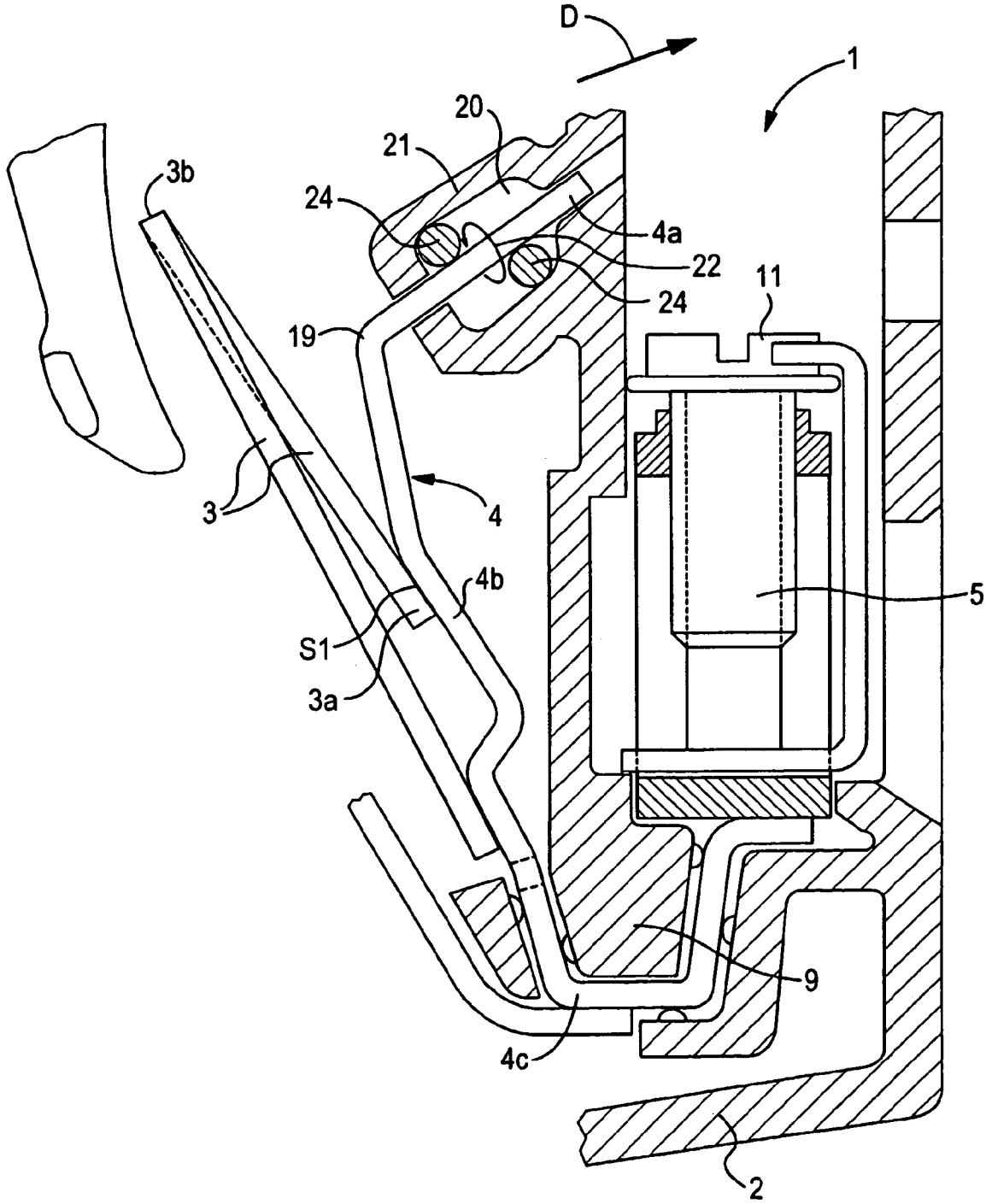

In the embodiment of the bimetallic strip mount 4 illustrated in FIGS. 8 and 9, the handling limb 4*a* is once again bent inwards and, in the process, is once again bent to form a first kinking/bending point 19'. The kinking/bending point 19' is—in the same way as the bending point 8—formed by a hole or a stamped region in the sheet-metal material of the bimetallic strip mount 4. At the free end, the handling limb 4*a* is passed into a housing receptacle or rotating opening 20, which acts as a rotating contour and is provided in a correspondingly positioned housing contour, expediently in the form of a dome-shaped housing fitting 21. The operating tool for adjustment of the bimetallic strip acts on this free end of the handling limb 4*a*, which is located within the rotating opening 20.

In this embodiment, rotation or twisting of the handling limb 4*a* in the direction of the illustrated double-headed arrow 22 once again results in the bimetallic strip mount 4 being bent or twisted, and in the position of the bimetallic strip 3 being varied in order to adjust the distance A. In this case, in the embodiment illustrated in FIG. 8, the handling limb 4*a* is rotated as rolling it up about an axis running at right angles to the plane of the drawing.

In the embodiment shown in FIG. 9, the handling limb 4*a* is twisted about its transverse limb axis. In the process, the handling limb 4*a* which is held or fixed in position in the area of the first kinking/bending point 19' and at the free end can be rotated or twisted by means of a rotation or handling tool 24, in the form of a fork, which for this purpose is inserted into the rotating or adjustment opening 20, and is rotated in the direction of the arrow 22. In this case as well, when the handling limb 4*a* is rotated in the direction of the illustrated arrow 22, the bimetallic strip tip or the free end 3*b* of the bimetallic strip 3 is once again rotated in the tripping direction D, thus resulting in the adjustment of the bimetallic strip. In this embodiment, the adjustment apparatus is formed essentially by the bimetallic strip mount 4 with the bimetallic strip 3 held on it, and the rotating opening 20 in the housing attachment 21, which acts as an adjustment contour.

Figure 10:
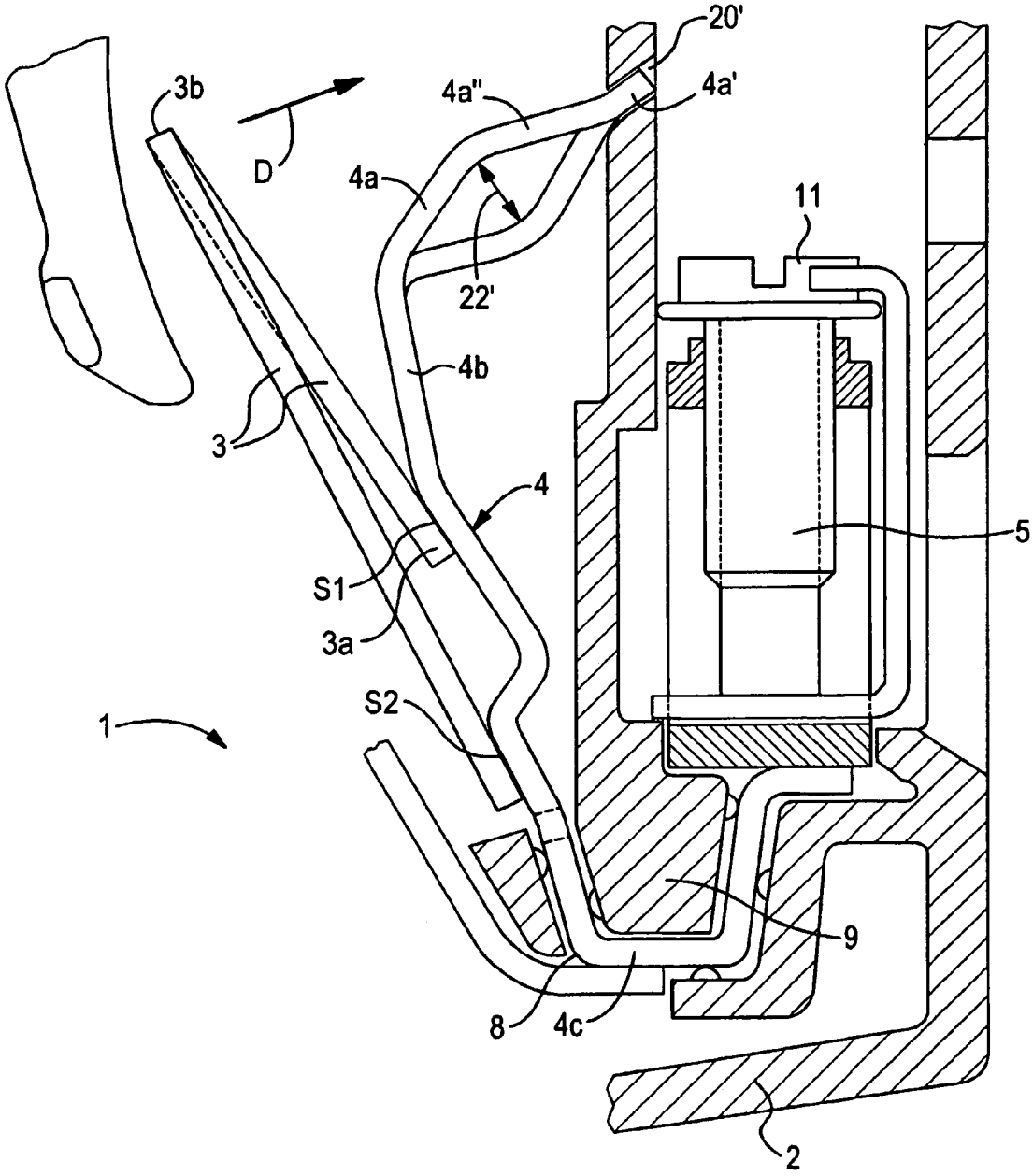

In the embodiment of the thermal release illustrated in FIG. 10, the bimetallic strip 3 is adjusted by a type of kinking bending movement of the handling limb 4*a* of the bimetallic strip mount 4 in the direction of the deformation arrow 22'. In this case, the free end 4*a*' of the handling limb 4*a* is held in a housing opening 20' so that the handling limb 4*a* can be bent out or in its central region 4*a*". In this case as well, during deformation of the handling limb 4*a* in the direction of the illustrated arrow 22', the bimetallic strip tip or the free end 3*b* of the bimetallic strip 3 is once again moved in the tripping direction D, thus resulting in adjustment of the bimetallic strip.

Figure 11:
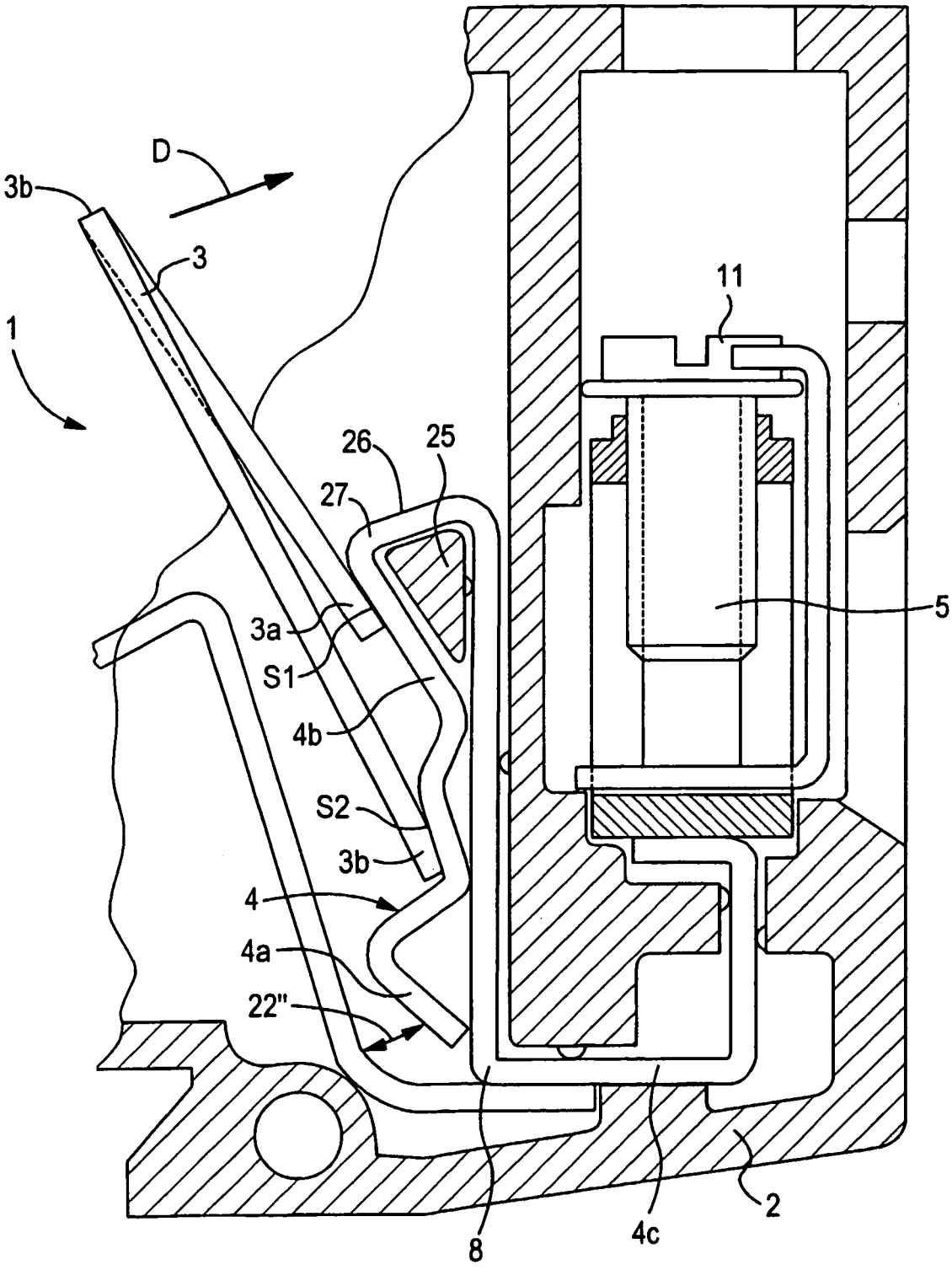

FIG. 11 furthermore shows an alternative embodiment, in which the holding limb 4*b* of the bimetallic strip mount 4 is guided around a housing contour 25, forming a loop. In this case, a desired bending point 27 is incorporated in the bimetallic strip mount 4, in the area of the loop apex 26 of the bimetallic strip mount 4. In this embodiment, the end of the handling limb 4*a* is located in the junction region between the holding limb 4*b* and the fixing limb 4*c* and in the process is located in the vicinity of the bending point 8 in the bimetallic strip mount 4, where it is supported. Rotation or bending of the handling limb 4*a* about the desired bending point 27 in the direction of the arrow 22" once again results in the bimetallic strip tip or the free end 3*b* of the bimetallic strip 3 being rotated in the tripping direction D, thus adjusting the bimetallic strip.

Figure 12:
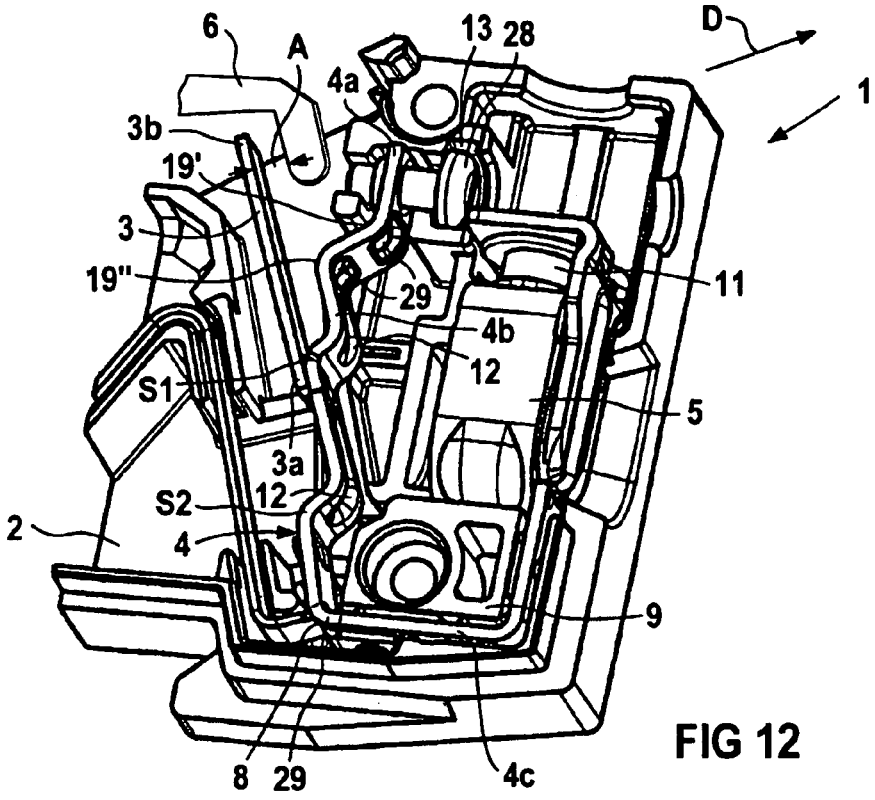
FIGS. 12 and 13 show, respectively, in the form of a plan view and a perspective illustration a thermal release, which is finally mounted in a switching device, with a further adjustment apparatus having an adjustment means for the bimetallic strip mount with a short bimetallic strip.
Figure 13:
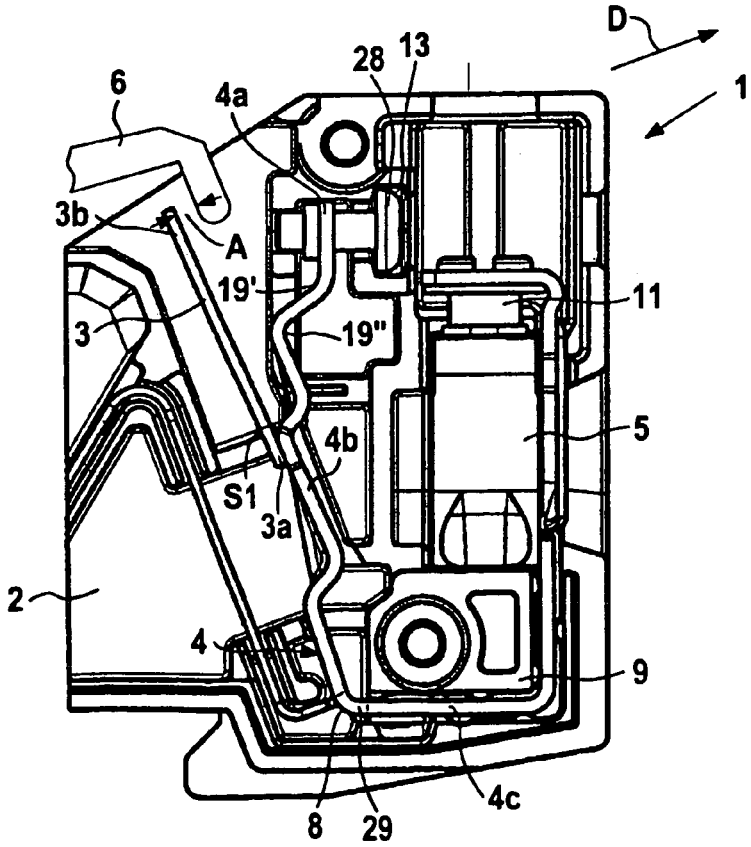

FIGS. 12 and 13 show an alternative embodiment of the thermal release which differs on the one hand from the embodiment of the thermal release illustrated in FIGS. 1 and 2 by the use of an adjusting device 28 in the form of an adjusting screw or, as an alternative to this, in the form of a plug-in pin or the like, which latches in steps. On the other hand, the handling limb 4*a* which can be adjusted by way of the adjusting device 28 is arranged to be very largely at right angles to it. Furthermore, the embodiment of the bimetallic strip mount 4 illustrated in FIGS. 12 and 13, and in contrast to the embodiment shown in FIGS. 1 and 2, is bent outwards at the first kinking/bending point 19', with the assistance of a hole/stamped-out region 29, which assists bending. The bimetallic strip mount 4 is bent adjacent to this, forming a second kinking/bending point 19", which is perforated by the hole/stamped-out region 29. The bending point 8 is formed in the same way as the kinking/bending points 19', 19".

In the further course of the bimetallic strip mount 4, beads 12 are likewise incorporated in the area of the steps S1 and S2 in the holding limb 4*b*, so that it is possible to use a relatively thin sheet-metal material for the bimetallic strip mount 4, while retaining a high degree of dimensional stability and adequate load-bearing stiffness. Beads 12 and bending and kinking/bending points 8 and 19', 19", respectively, which are provided with holes/stamped-out regions 29 can accordingly be incorporated deliberately depending on the desired method of operation, for example with partial stiffening and/or automatic readjustment in the form of an outward bend at desired bending points on the bimetallic strip mount 4.

In the embodiment illustrated in FIGS. 9 and 10 as well as 12 and 13, the mechanism which is used for adjustment of the bimetallic strip advantageously also compensates for material-specific subsequent housing shrinkage, which is in practice unavoidable. Typical materials are generally plastics, in particular thermosetting plastics or thermoplastics. A thermosetting plastic has in this case been found to provide particularly good thermal stability, with a thermoplastic being distinguished by a finer configuration capability. Thermosetting plastics, which are preferably used, are on the one hand urea resin molding compounds and, on the other hand, melamine resin molding compounds.

The reason for this is that, if the position of the tripping lever 6 changes in the direction of the free end 3*b* of the bimetallic strip 3 as a result of such subsequent shrinkage of housing, then this subsequent shrinkage of the housing—depending on the embodiment variant of the thermal release—also results in movement closer to the housing contours which act as an adjustment contour, and in or on which the bimetallic strip mount 4 partially rests. The force which is thus introduced to the bimetallic strip mount 4 results in automatic kinking and/or bending of the kinking/bending points 19', 19" and, possibly, of the bending point 8, such that the distance A remains constant. This makes it possible to avoid undesirable premature tripping of the thermal release. The readjustment behavior of the bimetallic strip mount 4 can be defined by deliberately changing the geometric relationship between the bending point 8 and the kinking/bending point 19', 19".

The ageing processes which may possibly occur as a result of heating or radiation influences when low-cost materials are used, and the material/housing shrinkages that occur as a result of them can thus advantageously be compensated for in a simple manner. The adjustment apparatus according to an embodiment of the invention results in a relatively large deformation movement with a relatively short change in length, at the same time, of the bimetallic strip mount 4 which can be deformed for adjustment. This allows particularly sensitive or fine adjustment of the bimetallic strip 3 for a thermal release. The adjustment apparatus is in this case also suitable for cold adjustment, with there being no need for any additional adjustment elements, for example in the form of a screw or the like. This makes it possible to save costs since the bimetallic strip mount 4 can also be manufactured on relatively simple tools.

Furthermore, low-cost materials and, in particular, bimetallic strips 3 of different lengths can be used, which in turn leads to considerable cost savings. This adjustment apparatus means that the actual adjustment process is reversible, at least within certain limits. Furthermore, the adjustment process can be carried out with the device housing 2 open or closed. Furthermore, the adjustment apparatus and hence the thermal release are particularly insensitive to shock loads, since the bimetallic strip 3 is at the same time mounted in a robust manner.

An embodiment of the invention as explained above can be summarized as follows:

In order to specify a particularly low-cost adjustment apparatus which can be adjusted easily for a thermal release for a switching device 1, in particular a line circuit breaker, an embodiment of the invention provides for the distance A between the tripping lever 6 and the free end 3*b* of the bimetallic strip 3 to be adjustable by deformation of the bimetallic strip mount 4 for the thermal release, with a bimetallic strip 3 which is held in a fixed position on a bimetallic strip mount 4, whose free end 3*b* is at a distance from a tripping lever 6 and acts on the latter increasingly in the tripping direction D as a result of thermal deformation.

Exemplary embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

The invention claimed is:

1. An adjustment apparatus for a thermal release for a switching device, comprising:

a bimetallic strip held in a fixed position on a bimetallic strip mount, wherein a free end of the strip is at a distance from a tripping lever and applies force to the tripping lever increasingly in the tripping direction as a result of thermal deformation, the bimetallic strip mount including, a handling limb at the free end, a plurality of steps providing a plurality of points for connection for bimetallic strips of different lengths, and a holding limb running at least approximately parallel to the bimetallic strip, wherein the bimetallic strip is connected, at its contact end, to the holding limb, and wherein the distance is adjustable by manual deformation of at least one of the handling limb and the holding limb.

2. The adjustment apparatus as claimed in claim 1, wherein the holding limb is curved in the form of a step.

3. The adjustment apparatus as claimed in claim 2, wherein the distance is adjustable by at least one of twisting the handling limb, running transversely with respect to the holding limb, and by bending the holding limb.

4. The adjustment apparatus as claimed in claim 2, wherein at least one of the handling limb and the holding limb is in the form of at least one perforated plate including a plurality of openings, arranged one behind the other in the limb longitudinal direction.

5. The adjustment apparatus as claimed in claim 2, wherein the distance is adjustable by automatic deformation of at least one of the handling limb and of the holding limb of the bimetallic strip mount.

6. The adjustment apparatus as claimed in claim 5, wherein the distance is adjustable by bending of at least one of the handling limb and the holding limb of the bimetallic strip mount, at at least one of bending points and kinking/bending points which are predeterminable.

7. The adjustment apparatus as claimed in claim 6, wherein the bending is produced by shrinkages of a housing surrounding the apparatus and by the approximation, which results from this, of the housing contours which act as an adjustment contour and at least one of in which and on which the bimetallic strip mount partially rests.

8. The adjustment apparatus as claimed in claim 1, wherein the distance is adjustable by at least one of twisting the handling limb, running transversely with respect to the holding limb, and by bending the holding limb.

9. The adjustment apparatus as claimed in claim 8, wherein the distance is adjustable by automatic deformation of at least one of the handling limb and of the holding limb of the bimetallic strip mount.

10. The adjustment apparatus as claimed in claim 9, wherein the distance is adjustable by bending of at least one of the handling limb and the holding limb of the bimetallic strip mount, at at least one of bending points and kinking and bending points which are predeterminable.

11. The adjustment apparatus as claimed in claim 10, wherein the bending is produced by shrinkages of a housing surrounding the apparatus and by the approximation, which results from this, of the housing contours which act as an adjustment contour and at least one of in which and on which the bimetallic strip mount partially rests.

12. The adjustment apparatus as claimed in claim 1, wherein at least one of the handling limb and the holding limb is in the form of at least one perforated plate including a plurality of openings, arranged one behind the other in the limb longitudinal direction.

13. The adjustment apparatus as claimed in claim 1, wherein the bimetallic strip mount includes an at least approximately U-shaped fixing limb, adjacent to the holding limb via a bend.

14. The adjustment apparatus as claimed in claim 1, wherein the handling limb of the bimetallic strip mount is fixed in position.

15. The adjustment apparatus as claimed in claim 1, wherein the handling limb is positioned in the area of the free end of the bimetallic strip.

16. The adjustment apparatus as claimed in claim 1, wherein the holding limb of the bimetallic strip mount is shaped like a loop, and the handling limb is supported on the bimetallic strip mount.

17. The adjustment apparatus as claimed in claim 16, wherein a desired bending point is formed in the area of the loop apex of the bimetallic strip mount.

18. The adjustment apparatus as claimed in claim 1, wherein the distance is adjustable by automatic deformation of at least one of the handling limb and of the holding limb of the bimetallic strip mount.

19. The adjustment apparatus as claimed in claim 18, wherein the distance is adjustable by bending of at least one of the handling limb and the holding limb of the bimetallic strip mount, at at least one of bending points and kinking and bending points which are predeterminable.

20. The adjustment apparatus as claimed in claim 19, wherein the bending is produced by shrinkages of a housing surrounding the apparatus and by the approximation, which results from this, of the housing contours which act as an adjustment contour and at least one of in which and on which the bimetallic strip mount partially rests.

21. The adjustment apparatus as claimed in claim 1, wherein a hole region is arranged at at least one position of the bimetallic strip mount.

22. A switching device including the adjustment apparatus as claimed in claim 1.

23. The switching device as claimed in claim 22, further comprising a housing including at least one of urea and melamine resin molding compound.

24. A line circuit breaker as claimed in claim 22, further comprising a housing including at least one of urea and melamine resin molding compound.

25. The adjustment apparatus as claimed in claim 24, wherein the bimetallic strip mount includes a plurality of steps providing a plurality of points for fixed position contact with bimetallic strips of different lengths.

26. The adjustment apparatus as claimed in claim 24, wherein the bimetallic strip mount is in the form of at least one perforated plate including a plurality of openings.

27. The adjustment apparatus as claimed in claim 24, wherein the distance is adjustable by twisting of the bimetallic strip mount.

28. The adjustment apparatus as claimed in claim 24, wherein the bimetallic strip mount is manually deformable via direct contact by a user.

29. The adjustment apparatus as claimed in claim 24, wherein a top portion of the bimetallic strip mount is T-shaped.

30. The adjustment apparatus as claimed in claim 1, wherein a hole region is arranged in the area of the holding limb which is in the form of a step, in order to form at least one of a bending point and a kinking and bending point.

31. A line circuit breaker including the adjustment apparatus as claimed in claim 1.

32. The adjustment apparatus as claimed in claim 1, wherein the distance is adjustable by twisting of the bimetallic strip mount.

33. The adjustment apparatus as claimed in claim 1, wherein a top portion of the handling limb of the bimetallic strip mount is T-shaped.

34. The adjustment apparatus as claimed in claim 1, wherein at least one of the handling limb and holding limb is manually deformable via direct contact by a user.

35. An adjustment apparatus for a thermal release of a switching device, comprising:

a bimetallic strip mount including a plurality of steps providing a plurality of points for connection for bimetallic strips of different lengths; and a bimetallic strip held in a fixed position on the bimetallic strip mount, wherein a free end of the strip is at a distance from a tripping lever and is adapted to increasingly apply force to the tripping lever in the tripping direction as a result of thermal deformation, wherein the distance is adjustable by manual deformation of the bimetallic strip mount.

36. A line circuit breaker including the adjustment apparatus as claimed in claim 35.

37. A line circuit breaker as claimed in claim 36, further comprising a housing including at least one of urea and melamine resin molding compound.

38. A switching device including the adjustment apparatus as claimed in claim 35.

39. The switching device as claimed in claim 38, further comprising a housing including at least one of urea and melamine resin molding compound.

* * * * *